United States Patent [19]

Rolt

[11] Patent Number: 4,932,008

[45] Date of Patent: Jun. 5, 1990

[54] HINGE-MODIFIED FLEXTENSIONAL TRANSDUCER

[75] Inventor: Kenneth D. Rolt, Arlington, Mass.

[73] Assignee: Raytheon Company, Lexington, Mass.

[21] Appl. No.: 411,182

[22] Filed: Sep. 19, 1989

Related U.S. Application Data

[63] Continuation of Ser. No. 252,990, Oct. 4, 1988, abandoned.

[51] Int. Cl.[5] ..... H04R 17/00

[52] U.S. Cl. ..... 367/165; 367/158

[58] Field of Search ..... 310/26, 334, 337, 338, 310/339; 367/157, 158, 160, 162, 165, 167, 168, 172, 188

[56] References Cited

U.S. PATENT DOCUMENTS 3,325,780 6/1967 Horan ..... 367/157
3,939,467 2/1976 Cook et al. ..... 367/157
4,706,230 11/1987 Inoue et al. ..... 367/159 X
4,862,429 8/1989 Rolt ..... 367/165

OTHER PUBLICATIONS

The Random House College Dictionary, Random House Inc., 1975, p. 627.

*Primary Examiner*—Brian S. Steinberger
*Attorney, Agent, or Firm*—Denis G. Maloney; Richard M. Sharkansky

[57] ABSTRACT

A flextensional transducer provides a low resonance frequency by having its shell portions connected to its ends by a pin- or rotation-type hinge whereby the motion of the ends of the transducer caused by energization of the transducer drive is transferred to the shell portions by the hinge. The reduction in the resonance frequency is achieved by the shell portions acting as a hinged plate whose ends rotate relative to the transducer ends rather than being cantilevered as in the prior art.

13 Claims, 2 Drawing Sheets

HINGE-MODIFIED FLEXTENSIONAL TRANSDUCER

This application is a continuation of application Ser. No. 252,990, filed Oct. 4, 1988, now abandoned.

BACKGROUND OF THE INVENTION

This invention relates to flextensional electroacoustic transducers and in particular to flextensional transducers which have been modified to reduce the resonance frequency of the transducer for a given transducer size, or alternatively to result in a smaller transducer for a given resonance frequency.

A basic form of a flexural-extensional (flextensional) acoustic transducer of the prior art is shown in end-view in FIG. 1. The transducer 10 comprises a transduction driver 11, which may be a magnetostrictive rod or a stack of electrostrictive ceramic elements in a housing 12 comprising end portions 13 and flexible shell portions 14. The driver 11 is maintained in a state of compression by the shell 12. In operation, a change in polarity of electrical energization of the driver 11 causes the ends 13 to alternately extend, as shown by the arrows 15, and to retract. Upon elongation of the ends 13, the flexing shell portion 14 moves inwardly as shown by direction arrows 16 by an amount substantially greater than the amount by which the end 13 has been displaced at the same instant and vice versa. The transducer 10 is normally used to propagate acoustic energy in a water environment, and it is found that the flextensional transducer 10 provides a good means for transferring energy from the high acoustic impedance of driver 11 to the surrounding water by converting the small motion of the end 13 of transducer 10 to a much larger motion of the broader surface of the flexing shell 14 of the transducer 10. Transducers of the type described above may be found in W. J. Toulis, U.S. Pat. Nos. 3,277,433 and 3,277,537 and of H. C. Merchant, U.S. Pat. No. 3,258,738.

In many applications, it is desired that the acoustic energy be produced at a lower frequency than the resonance frequency of the transducer 10. However, optimum transfer of energy to the surrounding water is obtained at the frequency of resonance. The frequency of resonance of the transducer 10 is higher than the natural resonant frequency of the shell 12 alone because the shell is constrained at the ends 13 and due to the stiffening effect of the driver 11. Attempts to reduce the natural resonance frequency of the transducer 10 by making the shell 14 longer between ends 13 and/or reducing the shell 14 wall-thickness usually produce an unsatisfactory transducer in terms of handling (weight and size). Electroacoustic efficiency and effective transducer coupling may also suffer from these attempts to lower the transducer resonance frequency.

The natural resonance frequency of the shell 14 of transducer 10 may be approximately determined by considering the shell 14 to be a plate which is clamped at two ends. Such a plate has a resonance frequency that is proportional to $8(3EI/L^3)^{\frac{1}{2}}$ where E is the modulus of elasticity of the material of the plate, I is the moment of inertia of the shell wall cross section, and L is the length of the plate between the rigid clamps. In the transducer 10, the length L is approximately the distance between regions 17 and 18 which are approximately the transition points in shell 14 for the change in the direction of motion 15 of the end 13 and the motion 16 of the shell 14.

Prior art transducers having more than two shells have the same limitation with respect to resonance frequency because the shell ends must bend at their point of attachment to the drive mechanism. Illustrative embodiments of such transducers are shown in J. Butler, U.S. Pat. No. 4,742,499, which are incorporated herein by reference.

Another prior art transducer design in which this invention may be incorporated is similar to that shown in isometric view as the cuspidate-shaped transducer 50 of FIG. 6. In its prior art form as disclosed in H. C. Hayes, U.S. Pat. No. 2,064,911, and more recently in Butler U.S. Pat. No. 4,742,499, the transducer comprises three or more radiating curved plates 23″ which are rigidly attached to constraining blocks 51.

The curved plates or shells 23″ of the prior art are rigidly attached to compression blocks 51 by bolting or welding with a substantially tangential relationship of the curved plates 23″ and the surface 55 of the constraining blocks 51 to which they were attached. The plates 23″ could also be formed integrally with the constraining blocks 51 as by machining from a solid block of stainless steel, for example. The drives 11 are in contact with a center block 52, and at their outermost portions in contact with constraining blocks 51. A screw thread 53 extending through the drives 11 in conjunction with their accompanying nuts 54 is tensioned by nuts 54 against the constraining blocks 51 thereby providing compression of the drives 11 for reasons well known to those skilled in the art. These screw threaded rods (known as a tie rod in transducer art) are often omitted in flextensional designs of the prior art where the external shell alone is sufficiently strong to provide compression on the driver. In the cuspidate-variety of designs (such as those of Hayes and Butler) the shells usually need assistance from tie rods to provide compression. Electrical activation of the drives 11 causes the curved plates 23″ to become more-and-less planar depending upon the outward and inward motion, respectively, of the compression elements 51, respectively.

SUMMARY OF THE INVENTION

The aforementioned characteristic of a lower resonance frequency is achieved by a flextensional transducer constructed in accordance with this invention. More specifically, the transducer of this invention has its shell portions connected to the end portions by a pin- or rotation-type hinge whereby the motion of the ends of the transducer caused by energization of the drive is transferred to the shell portions by the hinge. The reduction in the resonance frequency is achieved by the shell portions which act as a hinged plate whose ends rotate relative to the transducer ends rather than as a cantilever as in the prior art.

BRIEF DESCRIPTION OF THE DRAWINGS

The aforementioned aspects and other features of the present invention will be apparent from the following description taken in conjunction with the accompanying drawings wherein.

DESCRIPTION OF THE PREFERRED EMBODIMENT

Figure 1:
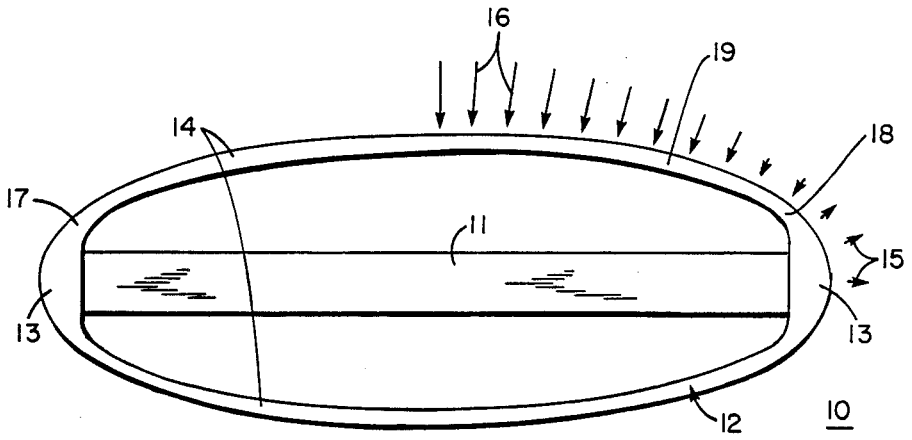
PRIOR ART FIG. 1
FIG. 1 is an end view of a flextensional transducer found in the prior art.
Figure 2:
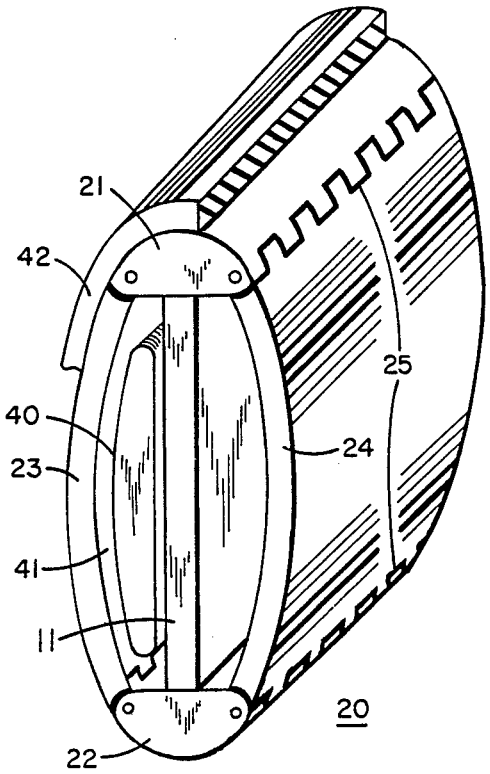
FIG. 2 is an isometric view of one embodiment of the invention.

One of the preferred embodiments of this invention is shown in FIG. 2 where an isometric view of a transducer is shown similar to that in FIG. 1. The transducer 20 of the invention comprises a driver 11 being held in compression by the ends 21, 22. The ends 21, 22 are each connected to shell portions 23, 24 by hinges 25. Assuming that the shells 23, 24 are of the same length and thickness as that portion of the flexing portion 14 of FIG. 1 between the regions 17, 18, and the drive 11 is the same in both transducers 10 and 20, the transducer 20 of FIG. 2 has a resonance frequency which is substantially half that of the transducer of FIG. 1. The hinges 25 will not allow a bending moment to be carried into the shell and lowers the stiffness of the shell plate, and hence lowers the transducer resonance frequency. The mechanical lever action of the shells 23, 24 and ends 21, 22 of the transducer of FIG. 2 remains as in the transducer of FIG. 1 because the shells 23, 24 are eccentric relative to the hinges 25. By this is meant that a shell motion of the ends 21, 22 away from each other results in a much larger inward movement of the shells 23, 24 and vice versa.

The resonance frequency of a plate whose ends are hinged and free to move longitudinally in the plane of the plate is proportional to $4(3EI/L^3)^{\frac{1}{2}}$. It is thus seen that the resonance frequency of the hinged plate is one-half that of the resonance frequency of the clamped plate. The movement of the shells 23, 24 is essentially that of a plate with hinged ends that are free to move in a longitudinal direction so that the natural resonance frequency of the shells 23, 24 would be substantially one-half that of shells 14 of FIG. 1 which must bend at their ends in the regions 17, 18. An outer waterproof covering or boot 42 of a flexible elastomer or plastic material would preferably be used to cover hinge 25 and the remainder of transducer 20 to seal the hinge 25 to prevent water from entering the transducer through the hinge 25 where the transducer is so constructed as to have its interior contain a gas.

Another advantage of the hinged flextensional transducer 20 of FIG. 2 is that the same resonant frequency may be maintained by making the entire transducer smaller than the rigid transducer 10 of FIG. 1 thereby miniaturizing the transducer.

Figure 3:
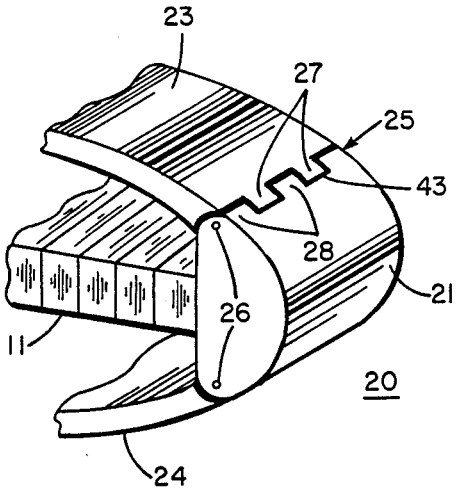
FIG. 3 is a partial view of the embodiment of FIG. 2 showing in more detail the hinge connection between the flexing portion and the end portion of the transducer of FIG. 2.

A detailed view of a suitable hinge 25 of the pin and dovetail type is shown in FIG. 3 which shows in partial sectional view the convex flextensional shell transducer 20 of FIG. 2. The end portion 21 and the shell 23 have their proximate end regions in mating interdigital relationship to form hinge 25 in which a pin 26 joins the interdigital portions 27, 28 of the shell 23 and end 21, respectively, through holes (not shown) in each of the interdigital ends 27, 28. The pin 26 may be press fitted into either one of the portions 27, 28 or may be retained by clips at the pin ends.

Figure 4:
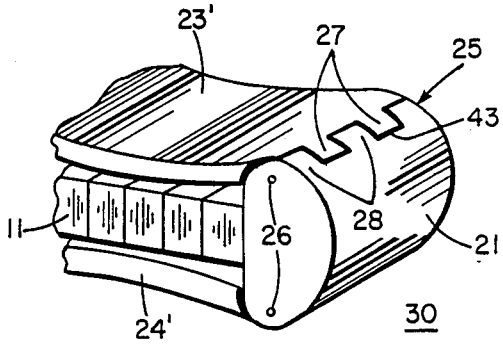
FIG. 4 shows a comparable view to that of FIG. 3 for the case of a concave flexing portion type of flextensional transducer.

FIG. 4 shows a partial view of a different form of flextensional transducer 30 similar to that known in the prior art wherein the flexing shell portions 23', 24' are concave as viewed from the exterior of the transducer 30. The hinge 25 of FIG. 4 is constructed in the same manner as that of FIG. 3 with corresponding parts being correspondingly numbered. The hinge 25 allows the concave shells 23', 24' to have the resonance frequency characteristics of the hinged-end flat plate thereby resulting in a transducer of lower resonance frequency than would be obtained if shells 23', 24' of the same size were rigidly attached to the ends 21, 22.

Figure 5:
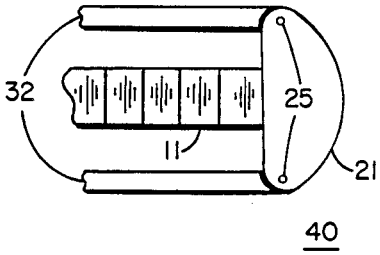
FIG. 5 shows a partial view of a transducer where the shell portions are flat plates hinged to end portions.

Another form of flextensional transducer in which this invention may be advantageously utilized is the flat shell type 40 shown partially in end view in FIG. 5. The flat shells 32 are connected by hinges 25 as in FIGS. 3, 4 to the end 21. Electrical energization of the transduction material 11 causes the shells 32 to resonate when the frequency of the electrical energization is at the natural resonance frequency of the shell 32. Because shells 32 are hingedly connected to ends 21, their resonance frequency will be substantially half that of the transducers of the prior art where the flat shells 32 were rigidly connected to the ends 21. The equation for the resonance frequencies are given earlier.

Figure 6:
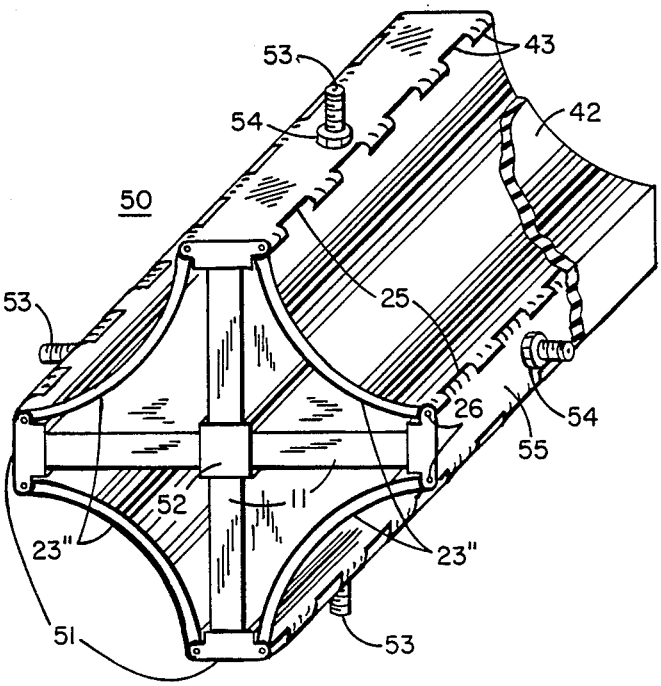
FIG. 6 is an isometric view of an asteroid-shaped flextensional transducer with hinge connection of its curved plates to the drive mechanism.

In the cuspidate-shaped embodiment of the transducer 50 of the invention shown in FIG. 6, the curved plates 23" are attached to the constraining blocks 51 by pin hinges 25 such as those shown in FIGS. 3 and 4. The hinges 25 allow the plate 23" to have a resonance frequency substantially equal to that of the hinged-end flat plate thereby producing a transducer 50 which has a resonance frequency substantially half that of a prior art transducer having the same curved plates which are rigidly attached to the constraining plates 51.

Figure 7:
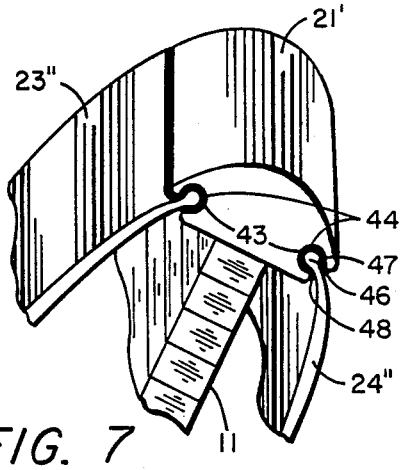
FIGS. 7 and 8 show in partial view other hinge arrangements suitable for use in this invention.

In the illustrative embodiments of FIGS. 2–6, the hinge 25 has been described as a pin-type hinge having interdigital members through which the pin passes to allow the interdigital members to rotate with respect to the pin and to each other without rotational constraint and in which an elastic sealant 43 may fill the space between the interdigital members 27, 28 to form a watertight seal. Seal 42 is preferred with a suitable lubricant for hinge 25 over a seal 43 since it is less lossy. Alternative embodiments of the hinge 25 appear in FIGS. 7 and 8. In FIG. 7, the hinge 44 comprises a bulbous cylindrical end 46 of shell 23", 24" which mates with a cylindrical opening 47 of the end 21'. The bulbous cylinder 46 has a diameter greater than the diameter of the opening 48 of the cylindrical opening 47 in order to prevent the bulbous cylinder 46 from being pulled through the opening 48 when outwardly directed pressure is provided on end 21' by drive 11. Assembly of hinge 44 is accomplished by sliding the bulbous cylinder 46 into the cylindrical opening 47. If it is desired to make the hinge 44 watertight, a seal 44 of an elastomeric material such as rubber or a plastic may be introduced in the space between the bulbous cylinder 46 and the cylindrical opening 47. Where a watertight connection is not required as when an external seal 42 (as in FIG. 2, but not shown in FIG. 7) is utilized, it may be desirable to use a material 43 which acts as a lubricant or noise suppressor in the space available in the hinge 47.

Figure 8:
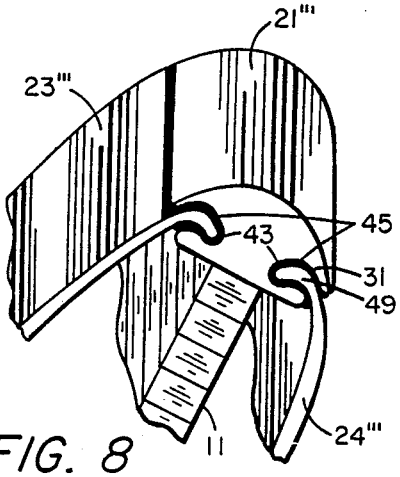

Another embodiment of a suitable hinge 45 is shown in FIG. 8 where the shell 24''' has a hook end 49 which mates with corresponding hook cavity 31 in end 21'''. The hook 49 in the cavity 31 provides a rotational hinge which will resist the outward motion produced by the compression of the drive 11 by the end 21''' acting upon the shells 23''', 24''' which are attached at their other end to an end corresponding to that of 21'''. The hinge 44 allows the shells 23''', 24''' which are attached at their other end to an end corresponding to that of 21'''. The hinge 44 allows the shells 23''', 24''' to rotate within the hooked cavity 31 of end 21''' when the drive 11 causes end 21''' to extend or to retract. A watertight seal 43 between the engaging portions 31, 49 of ends 21''' and shells 23''', 24''' provides a watertight hinge or if watertight hinge is not required, seal 43 may be utilized as a hinge lubricant to prevent noise generation in the hinge 45. Suitable materials for seal 43 would be an elastomer such as rubber or a plastic.

Although the embodiments of the flextensional transducer are illustrated in the Figures of this disclosure as hollow transducer housings having open ends, it will be understood that, as in the prior art, the housings are sealed with end plates (not shown) which are secured to the shells with an intervening rubber gasket in order to provide a watertight air- or gas-filled interior portion. An alternate embodiment could be a rubber bladder 40 (as in FIG. 2) which would contain a gas, such as air, to provide a compressible volume in the event the end plate seal was not used or was not a perfect seal. One or more air bags 40, such as shown in FIG. 2, would be desirable in the event the hinge 25 was designed to allow water to invade the inner compartment 41 of the flextensional transducer. Alternatively, if a watertight transducer housing with end plates is desired, the hinge 25 is preferably covered with a resilient plastic or an elastomer coating 42 which would provide a watertight seal on the outer or inner surface of the housing as shown in FIGS. 2 and 5. An alternative embodiment for sealing the hinge 25 would be a seal 43 as shown in FIGS. 3–7 in which a suitable sealing material (such as rubber or plastic) would fill the space between the interdigital members 27, 28 of the transducer housing to provide a watertight seal.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

I claim:

1. A flextensional electroacoustic transducer comprising:

a resilient housing having a plurality of shells each having opposite ends;

a transduction drive means within said housing;

a plurality of mating rotation-type hinge means for securing each end of the drive means to each end of each of the plurality of shells, said hinge means providing only a single pivot point for the movement of each end of each of the plurality of shells wherein said drive means comprises: a transduction drive member having opposite ends; end members in contact with said drive member ends, each said end member providing a first portion of each one of the plurality of said hinge means and each of said ends of the plurality of shells providing a second portion of each one of the plurality of said hinge means, with said single pivot point provided by the interconnection of said first and second portions.

2. The transducer of claim 1 wherein said shells have a shape selected from the group consisting of convex, concave, and flat as viewed from the transducer exterior.

3. The transducer of claim 1 wherein said end members are blocks.

4. The transducer of claim 3 wherein said first and second portions of said hinge means are adapted to withstand a tensioning force on said hinge means.

5. The transducer of claim 1 wherein said housing has a watertight seal covering at least said hinge means.

6. The transducer of claim 1 wherein the plurality of said rotatable hinge means comprises:

said shell ends having first fingers spaced from each other;

said drive means having second fingers spaced from each other;

said first and second fingers being intertwined with each other;

said first and second fingers each having a hole therethrough such that when interleaved, a concentric hole exists through said first and second fingers; and a pin extending through said interleaved first and second fingers.

7. The transducer of claim 6 comprising in addition sealing means over said first and second fingers to prevent water under pressure from passing between said first and second fingers.

8. The transducer of claim 1 wherein the plurality of said rotatable hinge means comprises:

said shell ends each having a cylindrical bulbous portion at each end;

said drive means having cylindrical slots;

each one of said cylindrical bulbous portions mating with each one of said cylindrical slots to provide zero-bending-moment rotational motion of said drive means with respect to said shell; and said cylindrical bulbous portion being larger than said cylindrical slot to retain said bulbous portion in said slot under tension between said shell ends and said drive means.

9. The transducer of claim 8 comprising in addition a watertight seal over said cylindrical bulbous portion and said cylindrical slot.

10. The transducer of claim 1 wherein the plurality of said rotatable hinge means comprises:

said plurality shells each having a curved portion in each end;

said drive means having curved slots which mate with each of said curved portions to provide a hinge which allows rotational motion of said drive means with respect to said shell;

said hinge resisting tension between said drive means and said shell in response to force produced by said drive means; and said hinge also providing zero-bending-moment rotational motion of said drive means with respect to said shell.

11. The transducer of claim 10 comprising in addition a watertight seal over said shell curved portion and said drive member curved slot.

12. The transducer of claim 1 wherein said shells are exterior concave.

13. The transducer of claim 1 wherein said shells are flat.

* * * * *